US007617844B2

(12) United States Patent
Schwane et al.

(10) Patent No.: US 7,617,844 B2
(45) Date of Patent: Nov. 17, 2009

(54) HEDDLE SHAFT WITH NOVEL CORNER CONNECTOR

(75) Inventors: Herbert Schwane, Raesfeld (DE); Richard Steffen, Borken (DE); Andre Olbing, Raesfeld (DE); Karl-Heinz Gesing, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 567 days.

(21) Appl. No.: 10/968,065

(22) Filed: Oct. 20, 2004

(65) Prior Publication Data

US 2005/0081942 A1 Apr. 21, 2005

(30) Foreign Application Priority Data

Oct. 21, 2003 (DE) ..... 103 49 381

(51) Int. Cl.
*D03C 9/06* (2006.01)

(52) U.S. Cl. ..... 139/91

(58) Field of Classification Search ..... 139/82, 139/91–92; 403/374.1, 363
See application file for complete search history.

(56) References Cited

U.S. PATENT DOCUMENTS

| | | | | | |
|---|---|---|---|---|---|
| 4,741,367 | A | * | 5/1988 | Kitawaki | 139/91 |
| 5,004,019 | A | * | 4/1991 | Blontrock | 139/91 |
| 5,005,607 | A | * | 4/1991 | Shimizu | 139/91 |
| 5,249,605 | A | * | 10/1993 | Graf | 139/91 |
| 5,887,629 | A | * | 3/1999 | Mettler et al. | 139/91 |

FOREIGN PATENT DOCUMENTS

| | | |
|---|---|---|
| CH | 336779 | 4/1959 |
| CH | 446220 | 3/1968 |
| DE | 379288 | 8/1923 |
| DE | 25 17 245 | 7/1976 |
| DE | 196 12 404 A1 | 10/1987 |
| DE | 198 58 013 | 2/2001 |

* cited by examiner

*Primary Examiner*—Shaun R Hurley
*Assistant Examiner*—Andrew W Sutton
(74) *Attorney, Agent, or Firm*—Fitch, Even, Tabin & Flannery; Norman N. Kunitz

(57) ABSTRACT

A novel corner connector for heddle shafts has detent means with which it can be retained in a shaft rod. The load-related locking is effected independently of the detent means by a clamping device that acts between the struts of the shaft rod.

11 Claims, 5 Drawing Sheets

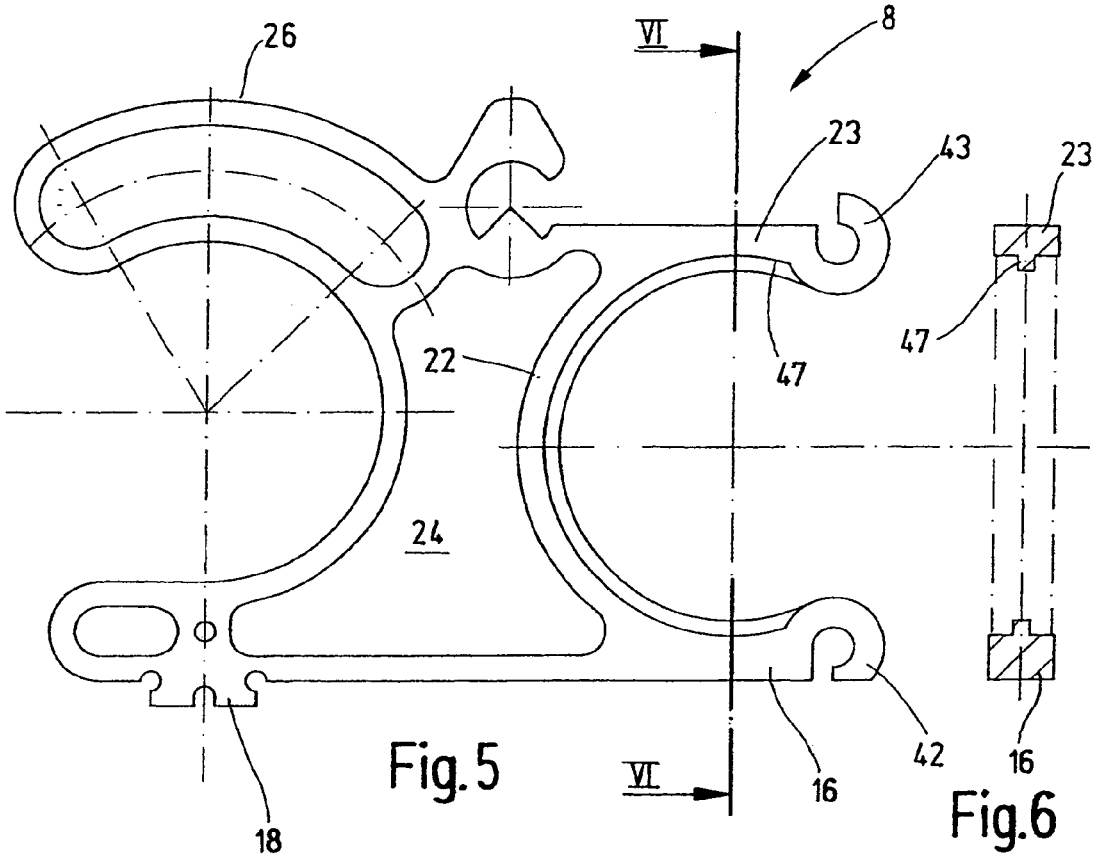
Fig.5
Fig.6
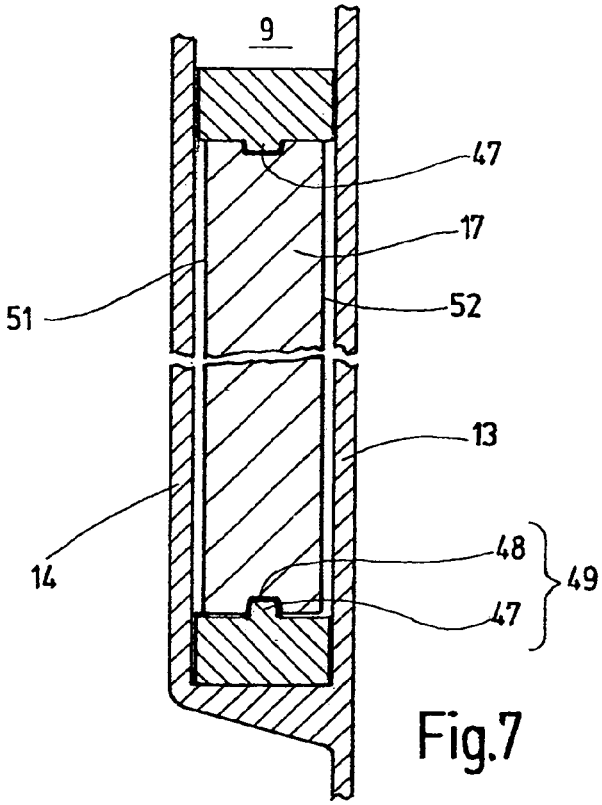
Fig.7

HEDDLE SHAFT WITH NOVEL CORNER CONNECTOR

CROSS REFERENCE TO RELATED APPLICATION

This application claims the priority of German Patent Application No. 103 49 381.6, filed on Oct. 21, 2003, the subject matter of which, in its entirety, is incorporated herein by reference.

FIELD OF THE INVENTION

The invention relates to a heddle shaft for power looms. In power looms, heddle shafts are used for instance for shedding. They have an upper and a lower shaft rod, which are joined together at their ends by lateral bracing posts. The upper and lower shaft rods are provided with heddle support rails, on which the heddles in large numbers are retained parallel to one another. Upon setup of the power loom, for instance because of a product change, heddle shafts must sometimes be removed from the loom. It is also necessary, for instance for changing the heddles, to remove the heddle shafts by removing the lateral bracing posts from the shaft rods.

BACKGROUND OF THE INVENTION

In high-output power looms, the heddle shaft is subject to a severe vibration load. This must not cause tearing of material, vibration breakage and the like at any point of the heddle shaft, including at the ends of the heddle shafts.

The design of the connection between the lateral bracing posts and the shaft rods has been the subject in the past of various attempts at optimization:

From German Patent Disclosure DE 196 12 404 A1, a heddle shaft is known that has releasable corner connections between the lateral bracing post and the shaft rod. At each corner connection, a corner connector is inserted in the applicable hollow chamber and is riveted to the side wall of the hollow chamber embodied in the shaft rod. A pinlike protrusion provided on the lateral bracing post enters into a recess of the corner connector and is secured in this recess by a clamping screw. Once the clamping screw is loosened, the lateral bracing post can be removed.

The same reference, in a further embodiment, discloses a corner connection in which the pinlike protrusion is provided with an elastic bearing part, which fits over the flat pin on its top, its face end, and its underside. The bearing part 14 is intended to damp vibration.

From German Patent DE 198 58 013 C2, a connection between a shaft rod and a lateral bracing post is known for heddle shafts with a shaft-heddle system without heddle rod hooks. The connection includes a connecting piece, introduced into the hollow chamber of the shaft rod, that has a recess for receiving a pin provided on the lateral bracing post. This pin has a plastic adaptor and with it engages the aforementioned recess. A fastening screw extending through the pin longitudinally is anchored in a threaded piece that is seated in the connecting piece that has been inserted into the hollow chamber of the shaft rod. The connecting piece has a certain movability in the hollow chamber, in the longitudinal direction of the lateral bracing post, and is braced in one direction by two compression springs. On the top, it is braced by a screw, with which the precise position of the connecting piece can be adjusted. With this provision, the heddle play can be adjusted.

At high operating speeds of the power looms, heddle shafts are accelerated and braked very sharply, so that particularly in the region of the connecting points between the lateral bracing posts and the shaft rods, major forces occur. These must not cause damage to either the lateral bracing posts or the shaft rods. For this purpose, screws penetrating the pin longitudinally, or rivets extending through the side wall of the shaft rod, have proved to be weak points. Moreover, a corner connection should be as simple as possible to make and should not require any special tools.

With this as the point of departure, it is the object of the invention to create a heddle shaft for power looms that can be installed and uninstalled quickly and simply and has a high load-bearing capacity. This object is attained with the heddle shaft of claim 1:

SUMMARY OF THE INVENTION

The heddle shaft of the invention has a connecting piece which can be inserted into the hollow chamber, open on its end, of the shaft rod and secured there in detent fashion. In a sense it is clipped into place, requiring neither special skills nor special tools. Corner connections can thus be made quickly and simply. If the connecting piece is made of plastic, it can also exert a damping action. It can be manufactured as a one-piece plastic injection-molded part, making for low production costs.

Preferably, the connecting piece is locked into place in detent fashion between two struts of the shaft rod. Moreover, it transmits the driving forces from the lateral bracing posts to the shaft rod preferably two-dimensionally to the struts. As a result, a low load on the shaft rod and great durability are attained. For making the corner connection, no special tools or skills whatever are needed.

The connecting piece is retained in place relative to the longitudinal direction of the shaft rod by the detent lug. The transmission of force can be moved by contact faces of the adaptor that are disposed adjacent the detent lug. On the opposite side, a spring means is preferably provided as a means for bracing the connecting piece. A clamping piece can additionally be used here, which is provided with a clamping screw to be actuated from outside and presses against the side of the connecting piece opposite the detent lug in order to firmly clamp the connecting piece. On its top, the clamping piece has a contact face for the inside of the strut of the shaft rod and also has a threaded bore, in which the clamping screw is seated. The force transmission takes place over a large area as a result.

In a preferred embodiment, the connecting piece has retaining pieces that embrace the pin and are provided on their ends with spring means. These spring means form a resilient support for the lateral bracing posts, which increases the vibration resistance of the connection and is also considered advantageous in other ways.

It is also considered advantageous if the detent opening is a through opening, through which the detent lug is visible from outside. This has the advantage that differently colored connecting pieces, for instance, can be kept on hand, and it can be told at a glance from outside what the color of the connecting piece is. If connecting pieces designed to be of different sizes are available and for instance establish different heddle plays, then the setup of power looms is made substantially easier. With short shafts, for instance, connecting pieces can be used that establish lesser heddle plays, while for long shafts, connecting pieces of a different color that establish great heddle plays can be on hand. For that purpose, a set of different connecting pieces is preferably kept on hand.

In the set, connecting pieces of the same color have the same dimensions, while connecting pieces of different colors have different dimensions.

It is also possible to use uniform connecting pieces and to provide an adaptor between the pin and the connecting piece. The adaptor may have particular damping properties or spring properties. Moreover, as explained above for the connecting pieces, the adaptors may be kept on hand in different colors and different sizes, in order to establish different heddle plays. This is true regardless of how the connecting piece is secured in the shaft rod.

Also regardless of the specific embodiment of the connection between the connecting piece and the shaft rod, it is considered expedient of the connecting piece or the adaptor is embodied such that it keeps the pin away from the side walls of the shaft rod. This can be accomplished by a positive engagement between the connecting piece or the adaptor, on the one hand, and the pin on the other; the pin thickness in the transverse direction (measured perpendicular to the side walls of the shaft rod) is less than the inside diameter of the hollow chamber. The connecting piece and/or the adaptor is conversely braced on the side walls of the hollow chamber and thus keeps the pin away from the side walls of the shaft rod. The pin is preferably centered in the hollow chamber.

In summary, for the embodiments of the invention, the following advantages can be stated, which apply individually or cumulatively depending on the embodiment:

As a result of the possibilities indicated for adjusting the heddle play, the heddles can be prevented from becoming clamped on the support rail. Moreover, heddle breakage, canting of the heddles, or warp thread breaks can be prevented. Moreover, by adjusting the heddle play as needed, not only wear of the support rail and heddles but also noise originating in the shaft can be reduced. In addition, production variations can be compensated for or corrected. It is possible to adapt the heddle play to the shaft length. If they are made of plastic, the retaining pieces have a low weight and can have a vibration-damping function. The corner connection has a certain movability that counteracts breakage from vibration. Replacing the connecting pieces, for instance to adjust the heddle play or for repair purposes, is possible in a simple way without special tools, thanks to the detent connection.

Because of the detent connection between the connecting piece and the shaft rod, the position of the connecting piece is correctly defined. Once the connecting piece snaps into place, the associated fastening screw can be tightened without further adjustment. No special tool such as a torque wrench is needed for that purpose. The lateral bracing post makes do without a transverse bore, which makes the heddle shaft of the invention especially suitable for high-output power looms. The production costs are low. The connection makes do without expensive screw fasteners, rivet fasteners, or adhesive bonds, as well as with only very few individual parts.

Further details of advantageous embodiments of the invention will become apparent from the drawing, the associated description, or claims. In the drawing, exemplary embodiments of the invention are shown. Shown are:

BRIEF DESCRIPTION OF THE DRAWINGS

FIG. 5, a front elevation view of a connecting piece of the heddle shaft of FIG. 4;

FIG. 6, a sectional view of the connecting piece of FIG. 5, taken along the line VI-VI;

FIG. 7, a section through the heddle shaft of FIG. 4, taken along the line VII-VII;

In FIG. 1, a heddle shaft 1 is shown, to which an upper shaft rod 2, a lower shaft rod 3, and two lateral bracing posts 4, 5 belong. The shaft rods 2, 3 are joined together at their ends by the lateral bracing posts 4, 5 and thereby retained parallel to and spaced apart from one another. Both shaft rods 2, 3, as shown in FIG. 2 taking shaft rod 2 as an example, have one heddle support rail 6 each, on which a plurality of heddles 7 are retained with their end eyelets.

DETAILED DESCRIPTION OF THE INVENTION

Figure 1:
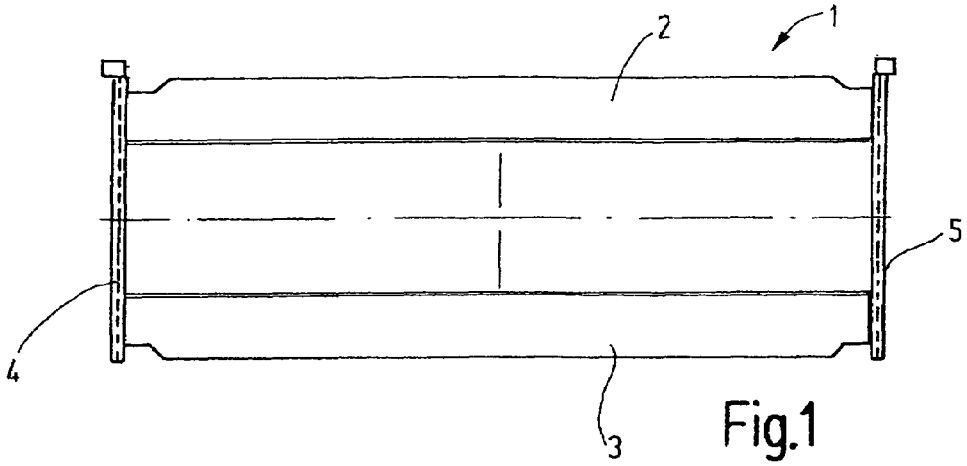
FIG. 1, a schematic front elevation view of a heddle shaft.
Figure 2:
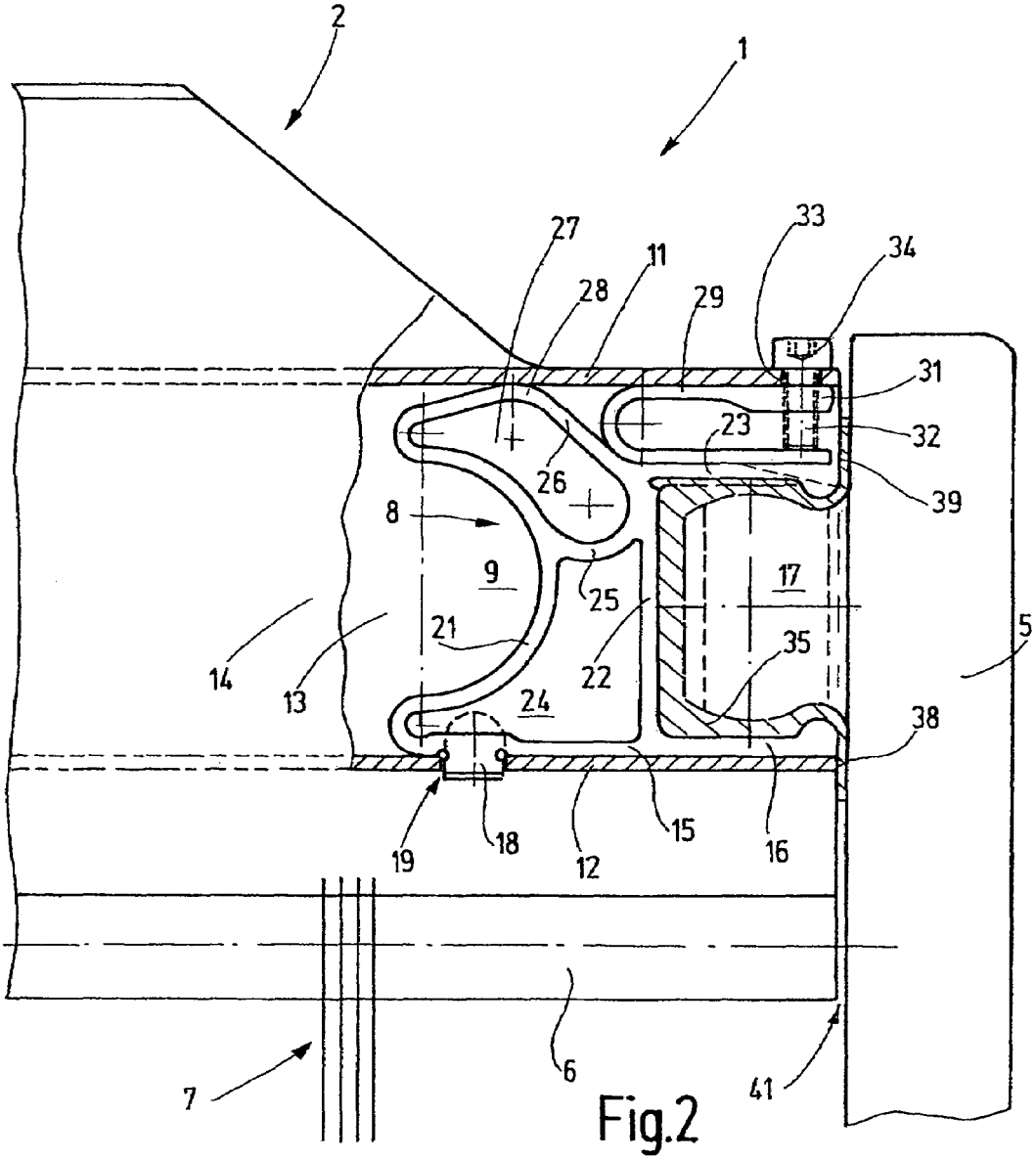
FIG. 2, a detail, partly in section, on a different scale of the heddle shaft of FIG. 1.

The heddle shaft 1 seen in FIG. 1 is distinguished in particular by the type of connection between the shaft rods 2, 3 and the lateral bracing posts 4, 5. This connection is shown in FIG. 2 as a representative of all four corner connections.

An essential element of the corner connection is formed by a connecting piece 8, which may be a plastic injection-molded element. It is inserted into a hollow chamber 9 of the shaft rod 2 that is defined at the top and bottom by a respective strut 11, 12 and by side walls 13, 14 and preferably has an approximately rectangular cross section. The shaft rod 2 may have one or more such hollow chambers. The cross section of the hollow chamber 9 preferably has a width (perpendicular to the plane of the drawing in FIG. 2) that is substantially less than its height. The height is the spacing between the struts 11 and 12. It is shown in FIG. 2 in the vertical direction, parallel to the plane of the drawing.

The connecting piece 8 is a molded body, for example, which on its underside has a plate or rib 15 that extends over its full length and that covers the width of the strut 12. On its end toward the lateral bracing post 5, it changes over to an arm 16, which as will be seen hereinafter serves to support a pin 17 integrally formed onto the lateral bracing post 5. On its end remote from the arm 16, the rib 15 has a detent lug 18, which protrudes downward past the lower plane face defining the rib 15 and engages a detent opening 19 embodied in the strut 12.

Beginning at the detent lug 18, the rib 15 continues in the direction of the strut 11 with an initially U-shaped portion 21 that is then bent into a C in the opposite direction. The rib also branches between the detent lug 18 and the arm 16 and then extends perpendicular to the strut 12, in the direction toward the strut 11. This portion 22 of the rib 15 extends as far as an upper portion of the rib that in turn forms an arm 23. The arms 16, 23 and the portion 22 thus define a jawlike receiving opening for the pin 17. Between the portion 22 and the portion 21, for receiving the connecting piece 8, there is preferably a plate 24 formed integrally with the rib 15. Above the plate, the portions 21, 22 are joined by a short strut 25, which with the upper part of the portion 21 and a spring segment 26 of the rib 15 defines an opening 27. The spring segment 26 is curved toward the strut 11 in order to rest on it with a bend 28.

A clamping piece 29 serves the purpose of further connection between the shaft rod 2 and the lateral bracing post 5 and is formed by a metal bracket bent into a U. Its upper arm, resting on the strut 11, has a threaded bore 31 in which a clamping screw 32 is seated. This screw is braced with its face end on the upper arm of the clamping piece 29, which arm rests on the arm 23. It also extends through the upper strut 11 in a through bore 33, so that its head 34 is located outside the shaft rod 2.

Figure 3:
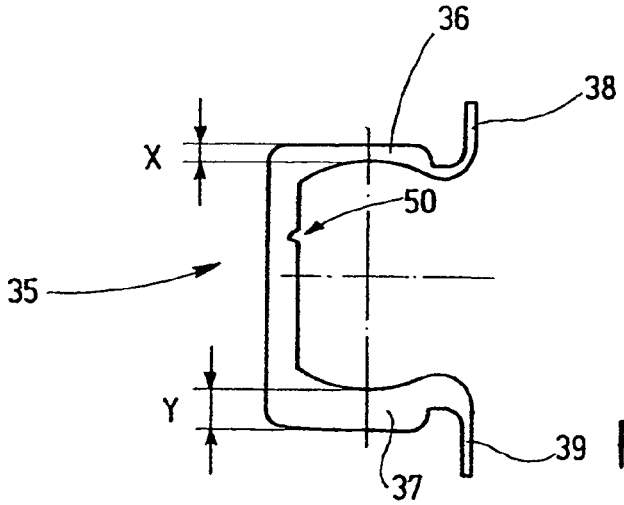
FIG. 3, a separate view of an adaptor in the corner connection shown in FIG. 2.

The pin 17 is substantially disk-shaped. Its width measured perpendicular to the plane of the drawing is less than the inside diameter of the hollow chamber 9. On its flanks oriented toward the side walls 13, 14, it is provided with plane faces 51, 52 (FIG. 7), while on its sides toward the arms 16, 23, it is curved in barrel-shaped or bow-shaped fashion. An adaptor 35, shown separately in FIG. 3, is preferably seated between the arms 16, 23 and the pin 17. It has a contour on the inside that is adapted to the pin 17 and a contour on the outside that is adapted to both the arms 16, 23 and the portion 22. In principle, it is horseshoe-shaped. Its upper arm 36 and its lower arm 37 may have the same, or as shown in FIG. 3, different, heights X, Y. These make it possible to establish two different heddle plays, depending on the orientation in which the adaptor 35 is placed on the pin 17. To make this possible, the upper and lower contours of the pin 17 are preferably embodied identically. The free ends of the arms 36, 37 are provided, as seen in FIG. 3, with short extensions 38, 39, located in the same line, that serve to establish the correct spacing between the lateral bracing post 5 and the shaft rod 2 and at the same time act as a damping shim in the gap 41 (FIG. 2) that exists there.

To make the connection between the shaft rod 2 and the lateral bracing post 5, the procedure is as follows:

As a preparatory step, the shaft rod 2, if this has not yet been done, is first provided with the detent opening 19, with the detent opening 19 being made, as FIG. 2 shows, in the lower strut 12 and, as indicated by dashed lines, optionally in one of the side walls, for instance the side wall 14, by means of a milling operation. The detent opening 19, to the extent that it penetrates the strut 12, is rectangular. The part extending into the side wall 14 forms a viewing window. The connecting piece 8 is introduced together with the clamping piece 29 into the hollow chamber 9; the spring segment 26 yields downward, and the detent lug 18 slides along the strut 12 until it enters the detent opening 19. By the action of the spring segment 26, the detent lug 18 snaps into the detent opening 19. The pin 17 is then provided with the adaptor 35 and thrust into the hollow chamber 9. The clamping screw 32 can now be screwed through the through bore 33 into the threaded bore 31 and tightened, so that arm 23 is pressed firmly against the adaptor 35, and the pin 17 is thus firmly clamped.

The adaptor 35 is preferably made from a plastic that is not excessively hard and that is somewhat resilient and damping, so that a vibration-absorbing connection is created between the shaft rod 2 and the lateral bracing post 5. The force transmission takes place essentially by means of the struts 11, 12, the clamping piece 29, the pin 17, and the arm 16. No local weakening of the lateral bracing post 5 or the shaft rod 2 can be demonstrated.

Figure 4:
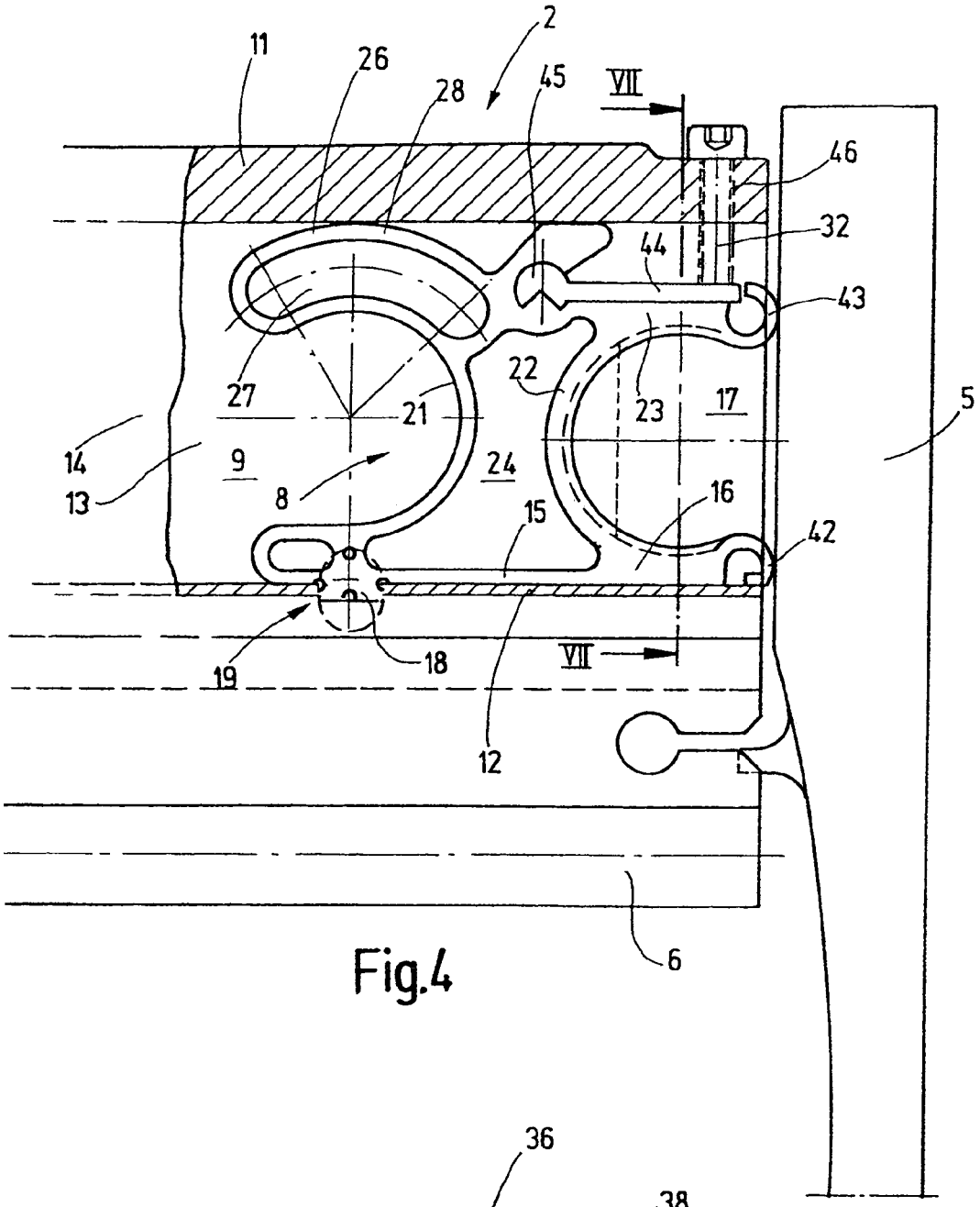
FIG. 4, a detail, partly in section, of a modified embodiment of a heddle shaft.

When the lateral bracing post 5 is uninstalled, the connecting piece 8 remains in the shaft rod 2. Only to change the heddle play, if there is no adaptor 35, can the connecting piece 8 be replaced by a different connecting piece 8 of a different embodiment. If there is an adaptor 35, then it is mounted on the pin 17 of the lateral bracing post 5, or retained in clamped form, and to change the heddle play, it is replaced by a different adaptor 35 of a different embodiment.

Where it is structurally or functionally identical to the exemplary embodiment described above, the same reference numerals as in the above description will be used without further explanation. For the rest, the following applies:

The connecting piece 8 surrounds an arclike pin 17 without the placement of an adaptor between them. The jaw defined by the arms 16, 23 and the portion 22 traces an arc. As seen particularly from FIG. 5, the free ends of the arms 16, 23 are provided with contact segments 42, 43, bent in an arc of slight radius and acting as spiral springs, which as shown in FIG. 4 resiliently brace the lateral bracing posts 5.

In addition, the upper spring segment 26 of the connecting piece 8, like the opening 27, is embodied in the shape of an arc. The spring segment 26 forms a spring that retains the detent lug 18 in the detent opening 19.

Instead of the clamping piece 29 bent in a U, only an elongated small clamping plate 44, resting on the arm 23, is provided, which is supported with a curved end 45 in a corresponding recess of the connecting piece 8. Here, the clamping screw 32 is anchored in a threaded bore 46 embodied in the upper strut 11. The strut 11 has a substantially greater thickness than the strut 12.

An essential special feature of the connecting piece 8 is seen in FIG. 6. Both on the inner contour of the arms 16, 23 and if needed on the portion 22 as well, a rib 47 is embodied, preferably centrally, and protrudes into the surrounding interior. Its function can be seen from FIG. 7. The pin 17 is provided on its outer circumference with a groove 48 that is just large enough that it can receive the rib 47 with little play. The width of the pin 17, measured between its flat sides 51, 52, is moreover substantially less than the inside diameter of the hollow chamber 9. As a result, the flat sides 51, 52 are retained spaced apart from and parallel to the side walls 13, 14. By means of the rib 47 and its positive engagement with the groove 48, the pin 17 is retained in centered fashion between the side walls 13,14, without touching them. Thus the rib 47 and the groove 48 form a means 49, acting by positive engagement, for orienting the pin 17.

Figure 8:
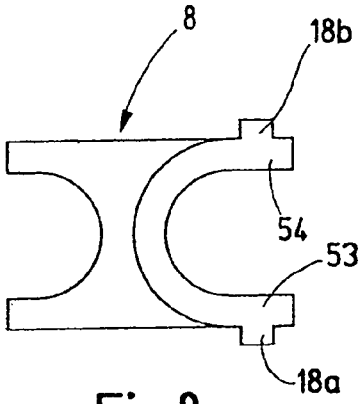
FIGS. 8 through 10, side views of connecting pieces for heddle shafts in different embodiments.
Figure 9:
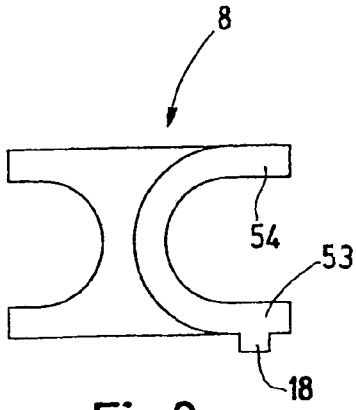
Figure 10:
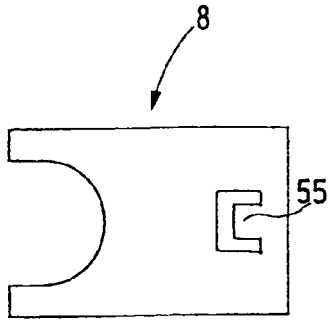

The connecting pieces described above each have a detent lug 18 and an associated spring means, for instance in the form of the spring segment 26. However, it is also possible, as indicated schematically in FIG. 8, to provide two detent lugs 18*a*, 18*b*, which are retained for instance on somewhat resilient arms 53, 54, oriented parallel to one another, of the connecting piece 8. As FIG. 9 shows, it also suffices if only one of the arms 53, 54 is provided with the detent lug 18. It is furthermore possible to dispose detent lugs on the flanks of the connecting piece 8, as seen in FIG. 10. In that embodiment, a detent means in the form of a detent tongue 55 may be provided on one or both flat sides of the connecting piece 8 and in that case engages a corresponding detent opening in the associated side wall 13 or 14.

Figure 11:
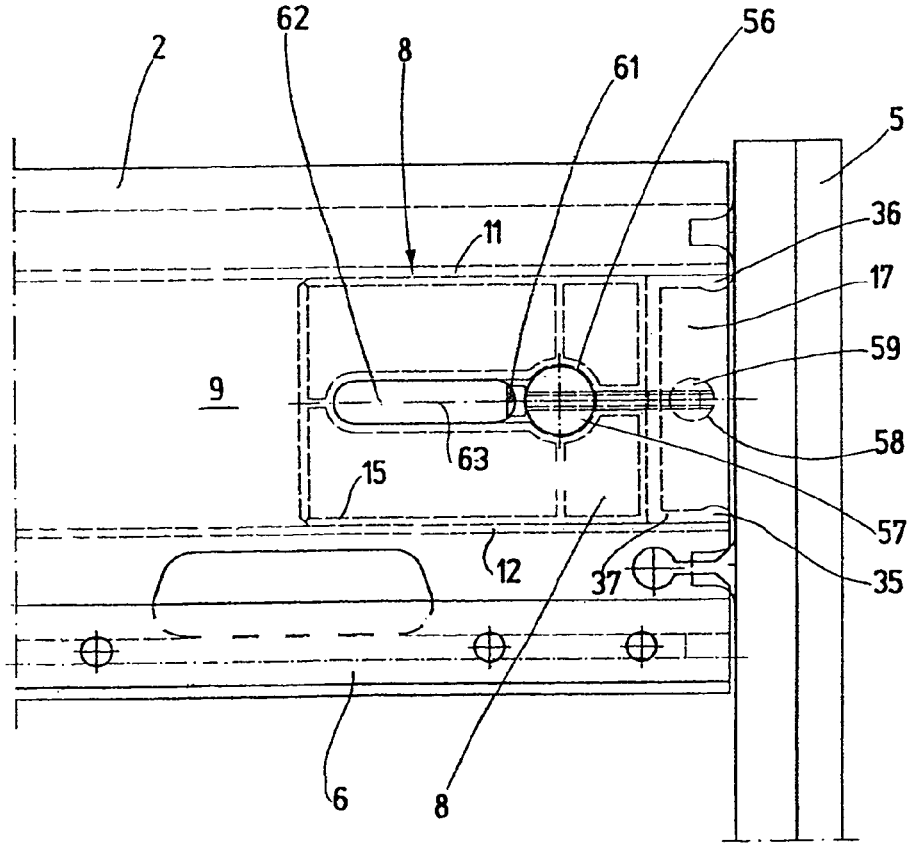
FIG. 11, in a schematic side view of a detail, a further embodiment of a heddle shaft.

A further embodiment of the corner connection between the shaft rod 2 and the lateral bracing post 5 is shown in FIG. 11. In it, the connecting piece 8 makes do without detent means. The side walls 13, 14 are provided with round through bores 56 that are aligned with one another and in which a cylindrical anchor 57 is seated. The pin 17 on which the adaptor 35 is retained is likewise provided with a transverse bore 58, in which a cylindrical anchor 59, provided with a threaded bore extending transversely through it, is disposed. A threaded bolt 61 extends through the anchor 57 and in the process is braced on it and is screwed to the threaded bore of the anchor 59, in order as a result to pull the lateral bracing posts 5 against the shaft rod 2. For actuating the threaded bolt 61, at least the side wall 13 but preferably both the side wall 13 and the side wall 14 are each provided with an elongated access opening 62. This opening assures access to the head of the threaded bolt 61. Otherwise, the connecting piece 8 fills the hollow chamber 9. Its rib 15 extending all the way around rests on the strut 12 at the bottom and on the strut 11 at the top. The arms 16, 23 rest on the struts 12, 11.

In the embodiment of the corner connection of FIG. 11, it is possible, as in all the embodiments described above, to keep both the connecting piece 8 shown and the adaptor 35 on hand in dimensionally different versions. The differences pertain solely to the thicknesses of the arms 16, 23, 36, 37. The inside diameter between the two arms 16, 23 and 36, 37, respectively, is always the same in these cases, and the surrounded contour in each case matches the contour of the pin 17. As a result of the different arm thicknesses, the various connecting pieces 8 and the various adaptors 35, however, establish different relative positions between the pin 17 and the struts 11, 12, so that when different connecting or adaptors 8, 35 are used, the spacing between the shaft rods 2, 3 can be changed in stages. This can be used to adjust the heddle play. Especially the connecting piece (intermediate piece) 8 shown in FIG. 11 can be embodied slightly asymmetrically, so that a rotation of 180 degrees about the schematically shown axis 63 causes a change in the heddle play.

Figure 12:
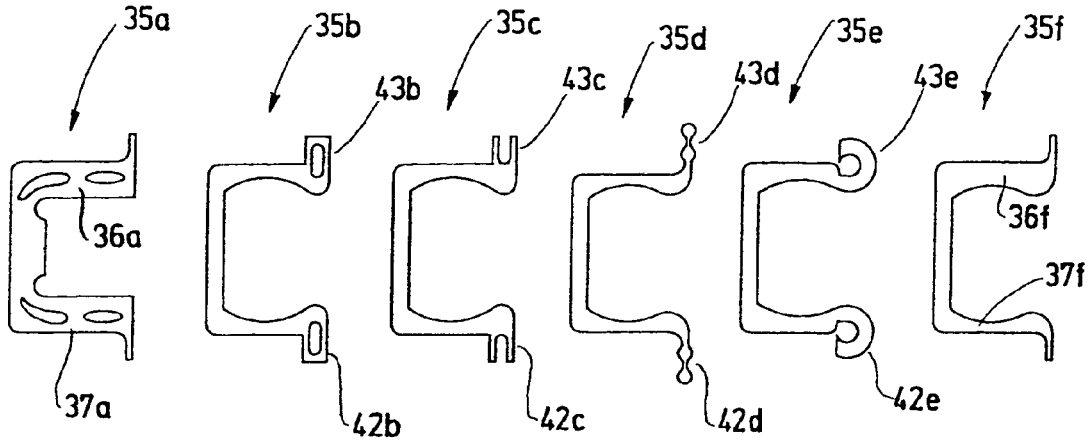
FIG. 12, schematic illustrations of various embodiments of adaptors for heddle shafts and for use in corresponding connecting pieces.

FIG. 12 shows various embodiments of adaptors 35*a*, 35*b*, 35*c*, 35*d*, 35*e*, 35*f*. For example, the adaptors may be symmetrical, as are the adaptors 35*a*, 35*b*, 35*c*, 35*d*, or 35*e*, or alternatively asymmetrical, like the adaptor 35*f*. The asymmetry exists here in terms of different thicknesses of the arms 36*f*, 37*f*. If needed, it is also possible, as for the adaptor 35*a*, to embody the arms 36*a*, 37*a* as spring elements. To that end, the arms 36*a*, 37*a* may have an increased thickness and recesses, which lend a compressibility in the longitudinal direction of the lateral bracing posts 5 to the arms 36*a*, 37*a*.

It is equally possible for the contact segments 42, 43 to have dissimilar resilience, as can be seen for the adaptors 35*b*, 35*c*, 35*d*, 35*e*, on the basis of the contact segments 42*b*, 42*c*, 42*d*, 42*e* and 43*b*, 43*c*, 43*d*, 43*e*. As a result, different spring hardnesses and damping actions can be attained.

Figure 13:
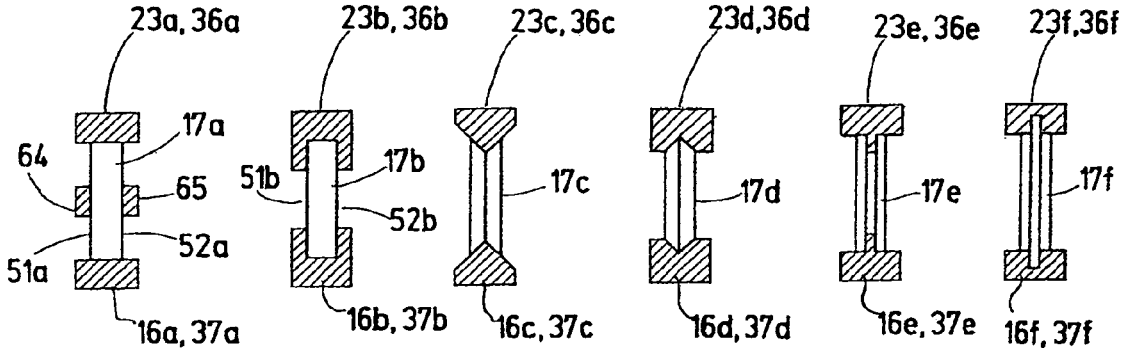
FIG. 13, in sectional views corresponding to FIG. 7, various embodiments of pins and adaptors and connecting pieces.

FIG. 13, as an alternative to FIG. 7, illustrates additional possibilities for designing positive-engagement means that center the pin 17 or otherwise keep it away from the side walls 13, 14. In the various versions, different designs of the arms 16, 23, and 36, 37 (distinguished by small letters after the numerals) are shown. For instance, the pin 17*a*, 17*b* may have a smooth outer circumference. For centering the pin 17*a*, fingers 64, 65 are provided, resting for instance on the flat sides 51*a*, 51*b*, and these fingers extend away from the portion 22 of the connecting piece 8. It is also possible to provide the arms 16*b*, 23*b* and 36, 37 with edges that fit over the flat sides 51*b*, 52*b*, respectively. The arms 16*c*, 23*c* and 36, 37 may also be trapezoidal in cross section; in that case, the pin 17*c* has a triangular groove extending all the way around. The configuration may also be reversed, as can be seen for the arms 16*d*, 23*d* and 36, 37 and the associated pin 17*d*. rectangular groove extending all the way around the pin 17*e* or a rib extending all the way around the pin 17*f* may also be provided, in which case the arms 16*e*, 23*e* and 16*f*, 23*f* are each embodied in complementary form.

Figure 14:
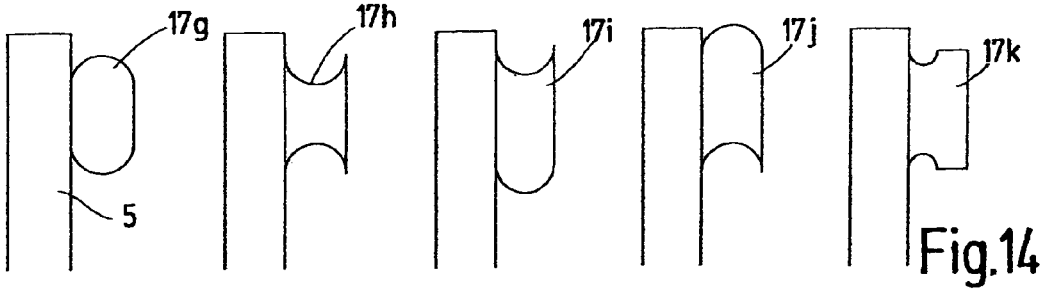
FIG. 14, schematic side views of various embodiments of lateral bracing posts and their retaining pins.

The pins 17 certainly need not be embodied as barrel-shaped or rectangular. It is possible, as FIG. 14 shows, to use the most variously shaped pins 17*g* through 17*k*, which permit a positive engagement between themselves and an adaptor 35 of suitably complementary shape or a connecting piece 8 of complementary shape.

Figure 15:
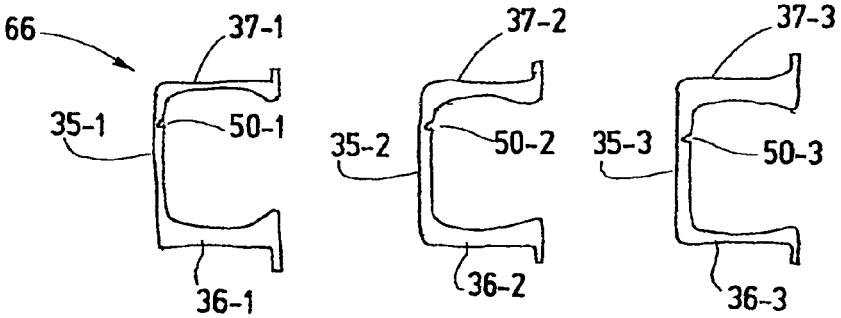
FIG. 15, a schematic side view of a set of adaptors for different heddle plays.

A further aspect of the invention resides in the use of a set of connecting pieces 8 with different arm dimensions, or as FIG. 15 shows, a set 66 comprising adaptors 35, 35-1, 35-2, 35-3, which have matching outer contours and matching inner contours but have arms 36, 37 of differing thickness. If the arms 37-1 through 37-3 for instance are in a ratio of 1:3:5 dimensionally to one another, and if the arms 36-1 through 36-3 are in a ratio of 6:4:2 dimensionally to one another, then six different amounts of play can be established, if each adaptor 35-1 through 35-3 is embodied as invertible, or in other words is symmetrical on both the inside and the outside. The adaptors 35 of the set 66 preferably have different identifying means, such as different colors, different final lengths, and so forth, as a result of which the adaptors can be made visually distinguishable, so that the installed position can be told at a glance. As FIGS. 3 and 15 show, in the adaptor 35, as an identifying means a notch 50, 50-1, 50-2, 50-3 may for instance be embodied, whose position identifies the arm thicknesses. These or similar means may be provided on the connecting piece for identifying its dimensions.

A novel corner connector for heddle shafts has detent means 18, 26 with which it can be retained in a shaft rod 2. The load-related locking is effected independently of the detent means by a clamping device that acts between the struts 11, 12 of the shaft rod 2.

It will be appreciated that the above description of the present invention is susceptible to various modifications, changes and adaptations, and the same are intended to be comprehended within the meaning and range of equivalents of the appended claims.

LIST OF REFERENCE NUMERALS

1 Heddle shaft
2, 3 Shaft rod
4, 5 Lateral bracing post
6 Heddle support rail
7 Heddles
8 Connecting piece (retaining piece)
9 Hollow chamber
11, 12 Strut
13, 14 Side walls
15 Rib
16 Arm
17 pin
18 Detent lug
19 Detent opening
21, 22 Portion
23 Arm
24 Plate
25 Strut
26 Spring segment
27 Opening
28 Bend
29 Clamping piece
31 Threaded bore
32 Clamping screw
33 Through bore
34 Head
35 Adaptor (retaining piece)
36, 37 Arms
38, 39 Extensions
41 Gap
42, 43 Contact segment

44 Small clamping plate
45 End
46 Threaded bore
47 Rib
48 Groove
49 Means
50 Notch
51, 52 Flat sides
53, 54 Arms
55 Detent tongue
56 Through bores
57 Anchor (threaded bolt)
58 Transverse bore
59 Anchor
61 Threaded bolt
62 Access opening
63 Axis
64, 65 Fingers
66 Set

What is claimed is:

1. A heddle shaft for power looms, comprising:

at least one shaft rod, on which a heddle support device is provided and which includes a hollow chamber, open at the end, with a wall in which a detent opening is embodied;

at least one lateral bracing post, which is joined to the shaft rod on the end of the latter and extends essentially perpendicular to it, and which is provided with a lateral pin extending into the hollow chamber; and, a unitary connecting piece, which has retaining arms embracing the pin, which is retained in the hollow chamber, and which has both a detent lug, associated with the detent opening, and a spring means that is disposed opposite the detent lug and that is braced on and contacts an inner surface of a portion of the chamber wall opposite that containing the detent opening.

2. The heddle shaft of claim 1, wherein the arms are provided on their ends with resiliently embodied contact segments.

3. The heddle shaft of claim 1, wherein the detent opening is a through opening, through which the detent lug is visible from outside.

4. The heddle shaft of claim 1, wherein an adaptor is disposed between the arms of the connecting piece and the pin.

5. The heddle shaft of claim 4, wherein the adaptor has two preferably resilient arms, with extensions embodied on their end regions.

6. A heddle shaft for power looms, comprising:

at least one shaft rod, on which a heddle support device is provided and whose wall includes a hollow chamber that is open at the end and that is substantially rectangular with a height greater than its width;

at least one lateral bracing post, which is joined to the shaft rod on the end of the latter and extends essentially perpendicular to it, and which is provided with a lateral pin that has two flat sides, which extend parallel to a longitudinal axis of the pin, and extends into the hollow chamber, a retaining piece which is retained in the hollow chamber and contacts inner surfaces of both narrower walls defining the chamber, said retaining piece having retaining arms, embracing the pin, that have positive-engagement fastening means for keeping the pin fixed with respect to a direction perpendicular to the flat sides so that the flat sides are disposed spaced apart from and parallel to the respective adjacent wall, forming gaps.

7. The heddle shaft of claim 6, wherein the retaining piece is a connecting piece, which is retained in a direct connection to the shaft rod.

8. The heddle shaft of claim 6, wherein the retaining piece is an adaptor, which is retained by a connecting piece that in turn is joined directly to the shaft rod.

9. The heddle shaft of claim 1, wherein:

the hollow chamber is substantially rectangular with a height greater than its width; the connecting piece directly contacts inner surfaces of both narrower walls defining the chamber.

10. The heddle shaft of claim 6, wherein: the positive-engagement fastening means comprises a rib that extends from one of an outer surface of the pin and an inner surface of the retaining arms, and that engages in a groove formed in one of the inner surface of the retaining arms and an outer surface of the pin.

11. A heddle shaft for power looms, comprising:

at least one shaft rod, on which a heddle support device is provided and which includes a hollow chamber, open at the end, with a wall;

at least one lateral bracing post, which is joined to the shaft rod an the end of the latter and extends essentially perpendicular to it, and which is provided with a lateral pin extending into the hollow chamber; and an asymmetrical retaining piece which is releaseably retained in the hollow chamber by at least one of a clamping screw and a spring detent, said retaining piece having two asymmetrically arranged opposite retaining arms with different thicknesses in a direction parallel to a longitudinal axis of the bracing post, with said arms embracing the pin and keeping the pin fixed, and which retaining piece is insertable into one open end of the hollow chamber of the shaft rod in either of two installed positions differing from one another by a rotation of 180 degrees about a longitudinal axis of the shaft rod in order to join the shaft rod to the bracing post in either of two different positions along the length of the bracing post.

* * * * *